United States Patent [19]

D'Agnolo et al.

[11] 4,171,105

[45] Oct. 16, 1979

[54] DEVICE FOR PLACING A COP WITH ITS YARN PULLED OUT INTO A MOVABLE STORAGE POINT

[75] Inventors: Armando D'Agnolo; Giovanni Favero, both of Pordenone, Italy

[73] Assignee: Officine Savio S.p.A., Udine, Italy

[21] Appl. No.: 788,685

[22] Filed: Apr. 18, 1977

Related U.S. Application Data

[63] Continuation of Ser. No. 687,217, May 17, 1976, abandoned, which is a continuation of Ser. No. 474,587, May 30, 1974, abandoned.

[30] Foreign Application Priority Data

May 30, 1973 [IT] Italy ..... 83378 A/73

[51] Int. Cl.[2] ..... B65H 54/22

[52] U.S. Cl. ..... 242/18 R; 242/35.6 E

[58] Field of Search ..... 242/18 R, 35.6 E, 35.6 R, 242/35.5 R, 35.5 A

[56] References Cited

U.S. PATENT DOCUMENTS

| | | | |
|---|---|---|---|
| 3,381,908 | 5/1968 | Igushi et al. | 242/35.6 E X |
| 3,850,378 | 11/1974 | Savio | 242/35.6 E X |
| 3,897,022 | 7/1975 | Savio | 242/35.6 E |
| 3,941,323 | 3/1976 | D'Agnolo et al. | 242/35.6 E X |

*Primary Examiner*—Stanley N. Gilreath

*Attorney, Agent, or Firm*—Stevens, Davis, Miller & Mosher

[57] ABSTRACT

A device for placing a cop with its yarn pulled out into a compartment of a movable storage point from a step-by-step conveyor comprising a retainer for the end of the yarn when found, a fork which can be positioned at an angle and which laterally and alternately cooperates with the compartments of the movable storage point and of the step-by-step conveyor, pincers which can be opened and which retain the end of the yarn when found integrally fixed to and located on the top of each compartment of the movable storage point, a verifier of the presence of the end of the yarn, shears for cutting off the excess part of the end of the yarn and a control device for discharging a cop of which the end of the yarn has not been found. The verifier acts in cooperation with the shears and the control device.

10 Claims, 11 Drawing Figures

DEVICE FOR PLACING A COP WITH ITS YARN PULLED OUT INTO A MOVABLE STORAGE POINT

This is a continuation of application Ser. No. 687,217 filed May 17, 1976, now abandoned, which in turn is a continuation of application Ser. No. 474,587 filed May 30, 1974, now abandoned.

The present invention relates to a device suitable for placing a cop with its yarn pulled out into a movable storage member. More specifically, the present invention refers to a device suitable for transferring cops, already arranged with the ends of their yarn location, from a conveyor into a movable storage-member which moves forward continuously or in a step-by-step fashion.

The step-by-step conveyor with single-cop compartments may be a part of any device suitable for finding the end of the yarn in a cop and for positioning the end relatively to the cop itself.

In accordance with the present invention, the device is suitable for detecting the presence of a cop in the opposite compartments of a movable storage point, the presence of a transferable cop in the step-by-step conveyor or the presence of an end of the yarn which has been found and positioned relatively to a cop that has been delivered into the movable storage point.

A device exists which deals with the placing of a cop with its yarn pulled out into a movable storage member. This device is suitable for movable storage members which move forward continuously or step-by-step where the storage members have linear, almost linear or circular paths, where the movable storage member consists of a number of containers positioned side-by-side, and where the cop to be placed in a horizontal or almost horizontal position, is already oriented and held between two mandrels.

Such a device is characterized by having means to detect the presence of a cop in a container, means to pre-arrange an empty container for the reception of a cop, means to find the end of the yarn in a cop, means to thrust a cop into a container, means to check that the end of the yarn has been found, means to deliver the end of the yarn to a container, means to cut off the excess part of the end of the yarn and means to discharge from a container a cop which has been placed there without the end of the yarn having been found.

The device has a number of disadvantages in that it is complex, is difficult to set the mechanism, rapidly transfers the cop, followed by the means that have found the end of the yarn and complexly delivers the end of the yarn.

The present invention foresees the use of a part of the known device and simplifies and greatly improves all the remainder of the device as well as makes the whole device itself extremely simple and completely reliable.

Furthermore, the present invention uses a conveyor device which, being upstream from the present invention and therefore not being a part thereof and, therefore, not being described, arranges for the end of the yarn to be found and to be positioned relatively to the cop.

The present invention therefore, provides a device which is very simple and easy to obtain for placing a cop with the end of its yarn pulled out into a movable storage point.

The present invention has for an object to make the cop carry out the smallest possible sideways movement.

An additional object is to guarantee greater reliability in delivery of the end of the yarn, as found, to the appropriate means for gripping the ends of the yarns which are present in the compartments of the movable storage point.

These and other objects make it possible to bring about notable useful features.

The first useful feature lies in the fact that levers are reduced to a minimum and the resulting device is solid and outstandingly simple.

Another useful feature is provided by the fact that delivery of the cop to the movable storage point takes place by a short sideways movement without the cop being strained by any force applied to the wound yarn.

Yet another useful feature lies in the fact that the cop is already inclined in the right position to be transferred by gravity into the movable storage point. These objects as well as the useful features listed, together with other objects and useful features, are attained by the device for placing a cop with its yarn pulled out into a compartment of a movable storage point, wherein the device has means for verifying the presence of a cop in the compartments of the movable storage point, cam means for pre-arranging an empty compartment of the movable storage point to receive a cop, means to fix the end of the yarn firmly to the compartment and means to discharge from a compartment of the movable storage point any cop which has been previously placed there without the end of the yarn having been found. The device is characterized by the fact that it has in reciprocal combination and in coordinated cooperation:

a fixed means for retaining an end of the yarn which has been found;

at least one fork means which can be positioned at an angle and which laterally and alternately cooperates with the compartments of the movable storage point and of the step-by-step conveyor;

pincers means which can be opened, which retain the end of the yarn when found and which are integrally fixed to each compartment of the movable storage point and are placed above the same;

a means for detecting the presence of the end of the yarn;

shears for cutting off the excess part of the end of the yarn, the shears acting in cooperation with the verifying means, and a control device for expelling a cop of which the end of the yarn has not been found.

The vertical transiting plane of the compartments of the step-by-step conveyor of cops with the ends of their yarn found is parallel to the compartments of the movable storage point in the loading area, the edges of the compartments being very close to each other.

The present invention will now be more clearly defined by means of the following non-limiting description and accompanying drawings in which.

Figure 1:
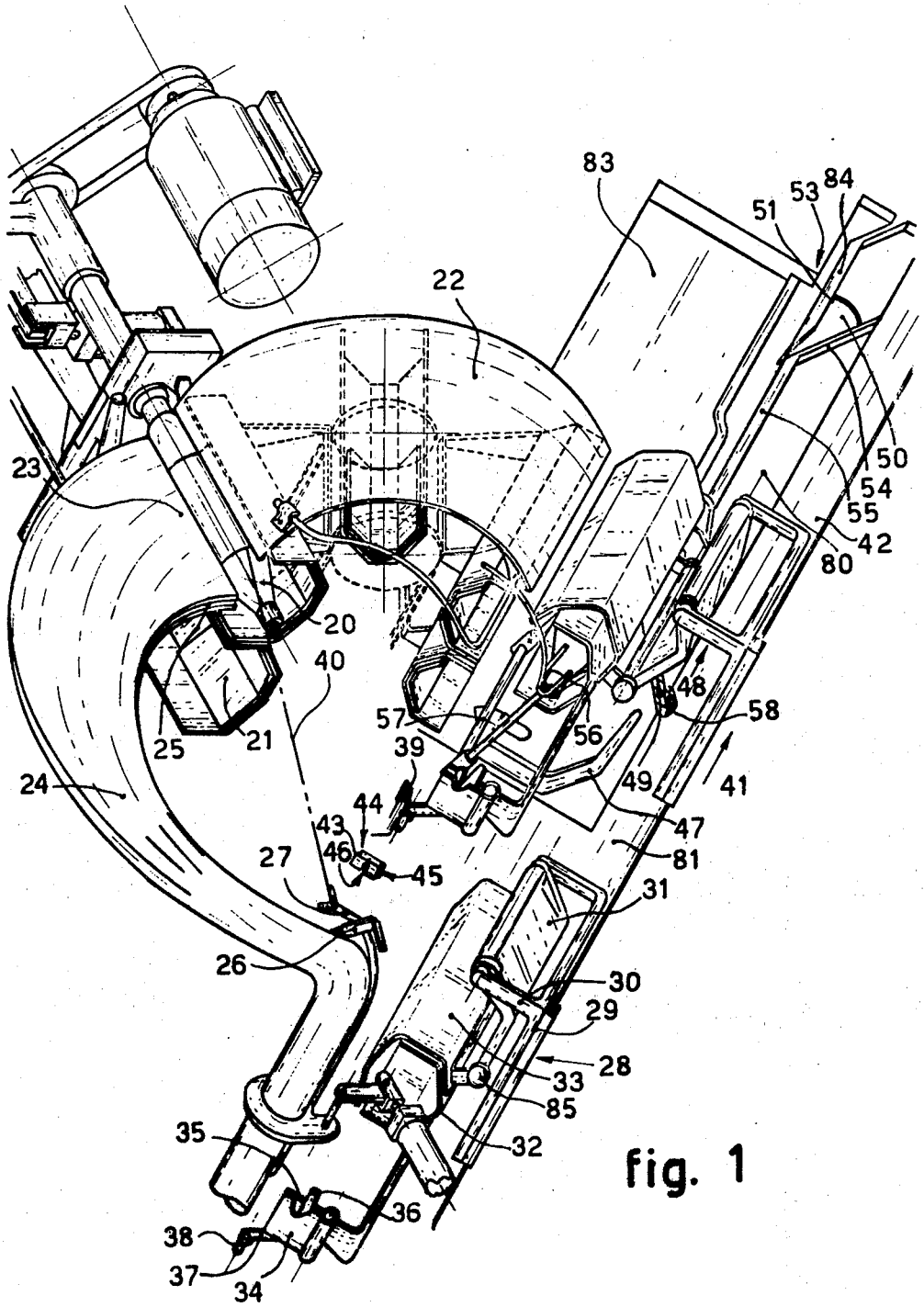
FIG. 1 shows an axonometric projection of a preferred device in accordance with the present invention.

Referring now to FIG. 1, there is shown cop 20, compartment 21 of a step-by-step conveyor of a preferred type which is only partially shown since the part upstream is not needed for understanding of the present invention, lateral containing projection wall 22; longitudinal suction opening 23 for picking up the end of the yarn: suction conveyor conduit 24, slit 25 for transferring the end of the yarn when found, mechanical shears 26 and a fixed, retaining suction opening 27. These components are part of a device for finding the end of the yarn. The step-by-step conveyor must include compartments which are open or can be opened frontally and which pass in front of the movable storage member at the loading station with a cop positioned in them with the end of the yarn already found.

Still referring to FIG. 1, the whole unit of a compartment of the movable storage member is referenced 28 and includes sliding element 29 with an elbow 30 for anchoring in a pivoting manner angled part 31 which carries a compartment 32 and the compartment cover 33. Element 29 and elbow 30 are stationary with respect to the belt which moves in the direction of arrow 48. The surface of the conveyor belt, and hence the storage station, is inclined with respect to the horizontal plane. The storage member unit 28 travels along the inclined plane. Thus the compartment 32 is also inclined and the cop lies therein sloping downwardly away from element 34. Angled element 31 is freely hinged to the end of the elbow 30, resting normally (not in the lifted position) in the position shown in FIG. 1 on the left. At the other end of element 31 the compartment 32 and the cover 33 are supported in such a way that when the end of element 31 rises the cover is removed relative to the compartment. The compartment and its cover may be arranged in many ways to perform this action. For example the cover 33 is made integral to element 31 while compartment 32 is rotatingly hinged at 82 and restricted in such a way that it always faces upward whether in the raised or the normal position, or said compartment may be integral to element 31 while cover 33 is made to open as the compartment rises say by means of a tension spring connected between some point on the back of the cover 33 and the elbow 30, otherwise said cover may be closed by compression spring and opened by a lever actuated by the rising up of the compartment and cover. On compartment 32 and above it there is a pincers-type retaining device 34 with fixed jaw 35 and movable jaw 36, which is activated by arm 37, which, by means of pin 38, cooperates with fixed cam 39 to overcome the loading of a spring (not shown here) and to open movable jaw 36 allowing the end of yarn 40 to enter and be clamped when the jaws close. There is a device 43 for detecting the end of the yarn and some shears 44 on the vertical plane which passes between retaining opening 27 and the inside of the "V" created by two jaws 35 and 36 of the pincers when 36 is open. This plane is parallel to the direction of forward movement 41 of movable storage member 42 (consisting of the catenary of compartments 28). Detector 43 and shears 44 shown here are as one unit (45) and have been obtained by modifying the operation of an electronic-type thread-clearer when a thread enters therein, the thread in this case consisting of the end of the yarn. Entry opening 46 of thread-clearer 45 (in the case adopted) lies on the aforesaid plane, and thread-clearer 45 lies below retaining suction device 27 and above and close to retaining pincers device 34. After that is shown, an arm device 47 for detecting an empty compartment 32, device 58 for switching the track of an empty compartment 32, direction 48 for a full compartment and device 50 for switching a compartment 32 loaded with cop 20 of which the end of yarn 40 has not been found. The rear tooth of the device 50 is 51, and, when a pin 52 (see FIGS. 2, 7 and 11) which guides compartment 32 passes by, reopens communication between a loading track 55 and track 54 which returns the compartment 32 into its cycle. A track 84 is provided for discharging at 53 any cop which has been loaded without the end of its yarn found.

Figure 8:
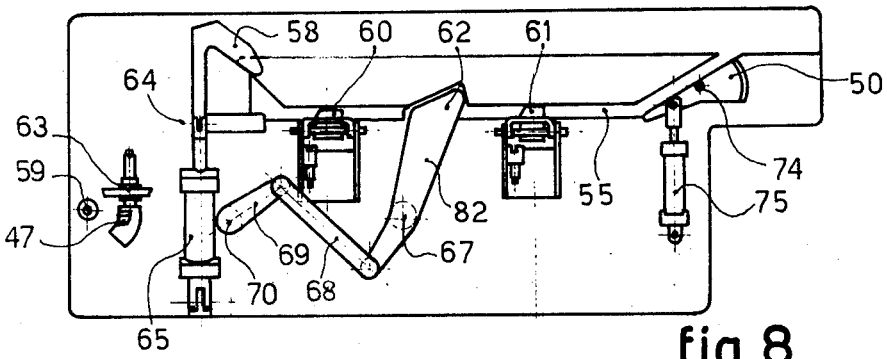
FIG. 8 shows a bottom view of FIG. 6.
Figure 9:
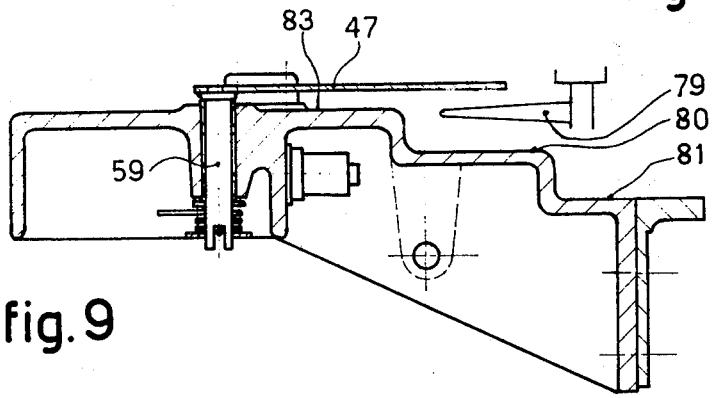
FIG. 9 shows a sectional view of FIG. 6 through line 9—9 of FIG. 6.
Figure 10:
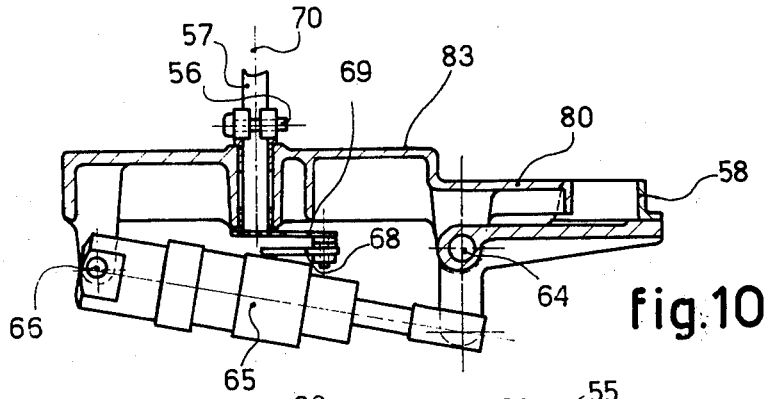
FIG. 10 shows a sectional view of FIG. 6 through line 10—10 of FIG. 6.
Figure 11:
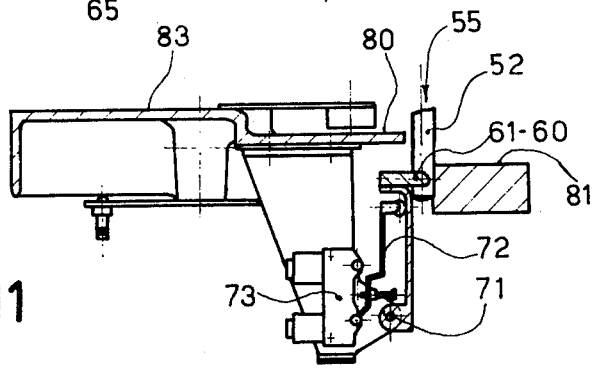
FIG. 11 shows a sectional view of FIG. 6 through line 11—11 of FIG. 6.

The drawings also show fork 56 together with their control shaft 57; axis of rotation 59 of arm-type detector 47; two devices 60 and 61 of FIGS. 8 and 11 to detect the passage of pin 52 along loading track 55 and are hinged at 71 and act with their arm against lever 72 of microswitch 73; cam 62 inserted in loading track 55 and machined onto the head of the lever 82, which is hinged at 67 and connected by means of intermediate arm 68 to lever 69, which lever 69 has its axis at 70 and is integrally joined to shaft 57 that carries the forks 56. The cam 62 acts in such a way that it is pin 52 itself which by passing along loading tract 55 actuates the sideways movement of forks 56 from compartment 21 to compartment 32. Microswitch 63 which, when it is activated by arm-type detector 47, prevents start up the cycle of deviation of compartment 32 and of loading a cop. Pivot 64 for the turning of the switching device 58, which is activated by the cylinder 65 hinged at 66. When the arm 47 detects that the compartment 32 is empty, the switching device 58 is normally prearranged to switch the compartment 32 along track 49 and that only the presence of a cop 20 in the compartment 32—a presence which is detected by its activation of the lever 47 actuates switching device 58 and thus removes the blockage by which said switching device 58 prevents the movement of 32 along the direction 48. Pivot 74 of rotation of switch 50, is activated by cylinder 75 to move pin 52 from the track 55 into track 84 instead of into the track 54, while the previous situation is re-established by pin 52 itself when it continues its course and presses against tooth 51. Compartments 32 of the movable storage member 42, are guided by guides 76 and 77.

Figure 2:
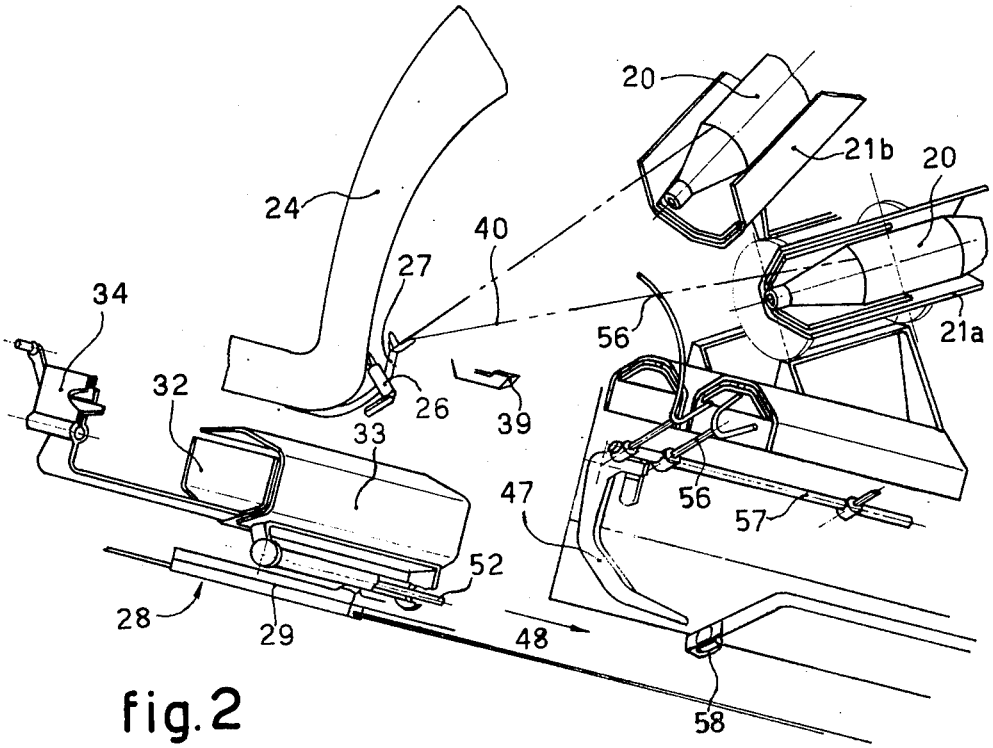
Figure 5:
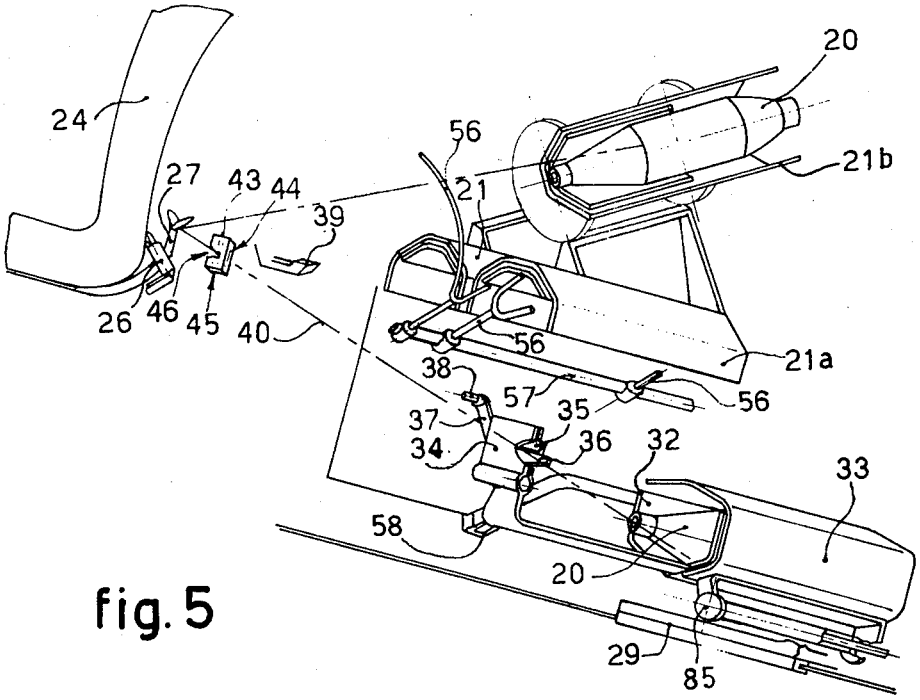
Figure 4:
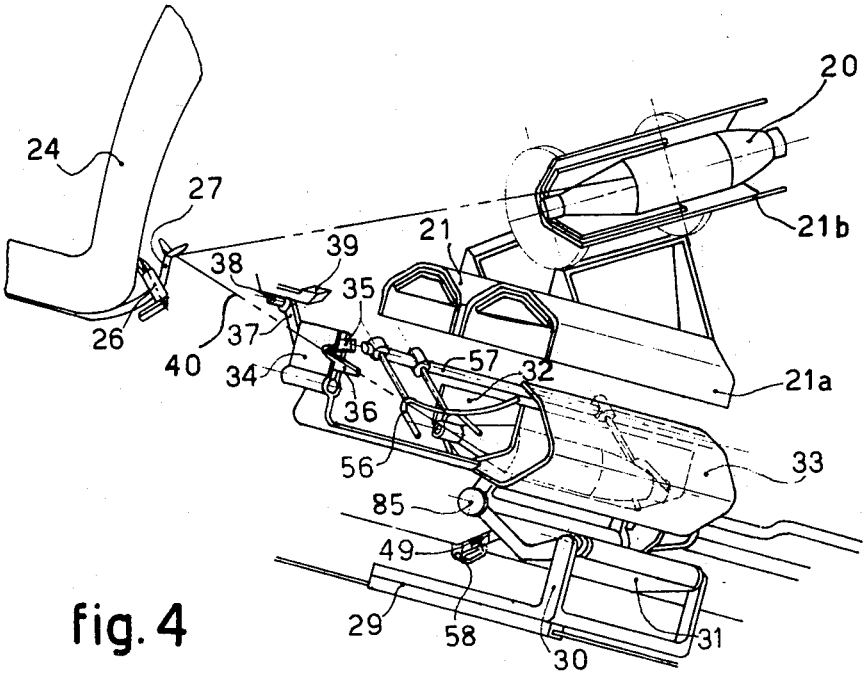
Figure 6:
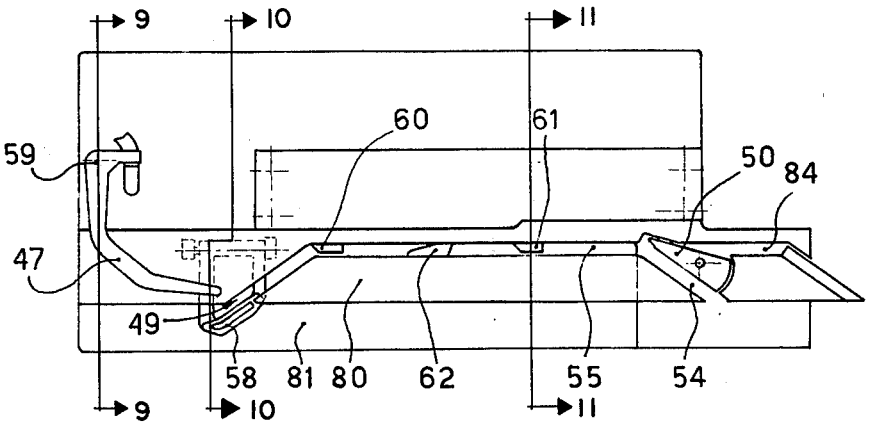
FIG. 6 shows a plan view of the linear cam which pre-arranges the compartments of the device of FIG. 1.

The catenary of compartments 21 of the preferred step-by-step conveyor rotates about axis 78, and in the example one step is equal to one quarter of a turn of axis 78. Below the compartments 32 is supporting surface 79 which is integrally fixed to sliding means 29. To be specific 79 is integral to storage member unit 28, its function is to stop the cop from sliding down the inclined compartment and it is stationary relative to elbow element 30 and may be integral thereto. This brings about the condition that, when pin 52 is in guides 84 and 55, compartment 32 has no supporting surface underneath and cop 20 present therein runs along surface 83. Only when pin 52 enters track 54, does cop 20 move sideways with a small leap and fall onto surface 79. On loading surface 80 there are tracks to guide pin 52. Connected to loading surface 80 is normal surface 81. The surfaces 80, 81 and 83 are all perpendicular to the surface on which travel the compartments and they are all parallel. They are displaced relative to each other to save space and allow for the passage of the movable compartment units. Pin 52 lies in its lower position on axis 85, which by passing along track 84-54 and 55 conditions the momentary position of compartment 32 in relation to compartments 21 and to sliding means 29. The track in which runs the pin 52 is dug out in plane or surface 80 in such a way as to make a groove which has a depth equal to the displacement between planes 81 and 80 so that the pin 52 whose end is close to surface 81 in the normal traveling position enters grooves 55, 54 or 84 when said pin is in the raised up position. The whole is clearly shown in FIGS. 6, 7, 9 and 10. Looking now to FIGS. 2 to 5 for the operation it is seen that in FIG. 2 compartment 32 moves forward empty, that is, without a cop 20. This temporary situation is verified by feeler means 47, which does not activate microswitch 63 (FIG. 8) and, therefore, does not activate cylinder 65, so that switch device 58 remains raised and blocks free movement of pin 52 along direction 48. Meanwhile, cop 20 with the end of its yarn 40 pulled out and positioned in retaining suction opening 27 is located in the compartment **21*a*** of the step-by-step conveyor.

Figure 3:
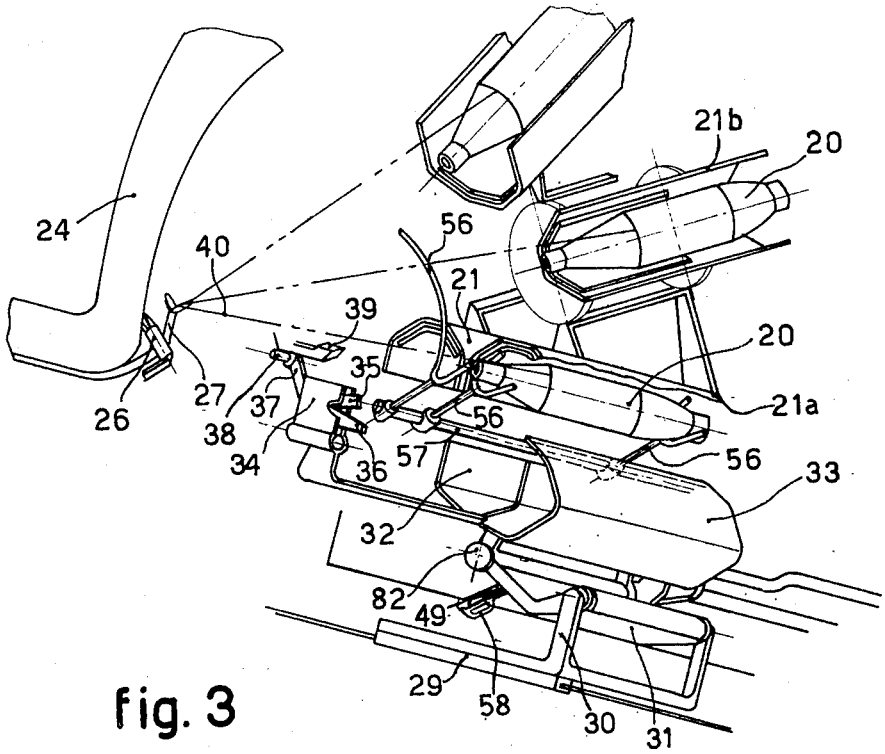
FIGS. 2 to 5 show in perspective and in four successive phases the working cycle of the device of FIG. 1.
Figure 7:
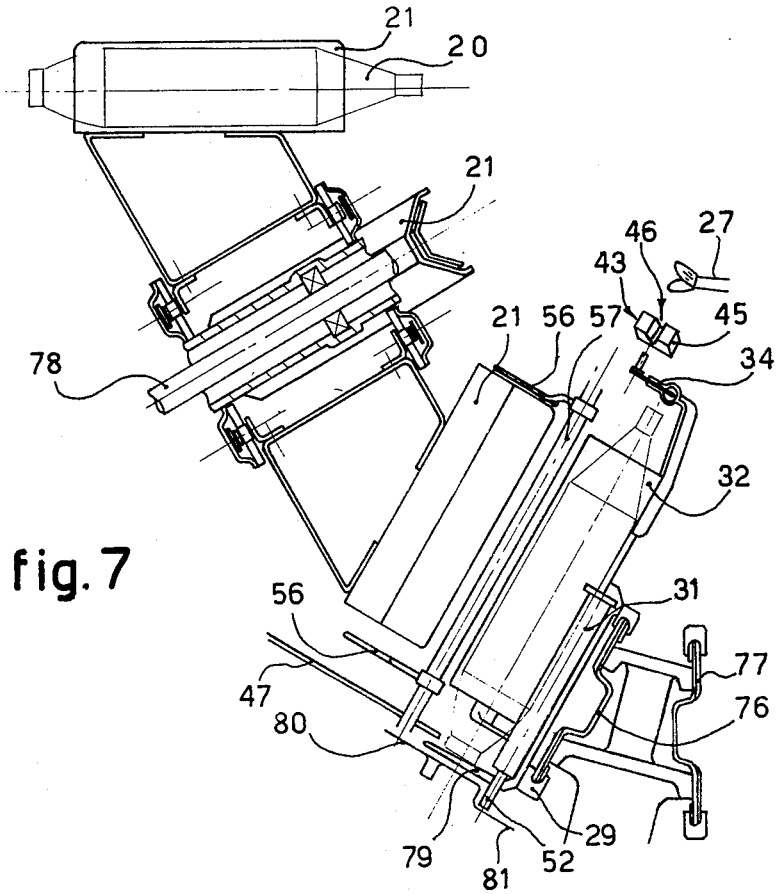
FIG. 7 shows diagrammatically and in a transverse section the axis of rotation of a step-by-step conveyor as in FIG. 1.

Since there is no cop 20 in compartment 32, when the latter moves forward (see FIG. 3) it is deviated by switching device 58 along track 49 so that pin 52 enters loading track 55, and therefore, the compartment 32 moves forward and the compartment cover 33 moves laterally with respect thereto. Switching device 58 is a lever positioned at the entrance to the upward sloping track 49. This lever is always in an open position ready to intercept pin 52 and deviate it upward except when the compartment has been judged empty by feeler 47; in the latter case lever 58 is drawn up and pin 52 carries on undeviated and the compartment does not rise. When the compartment 32 moves forwards the surface 83 and finds itself positioned below. Continuing to advance along track 55, pin 52 activates detector 60 (FIG. 6), which emits a signal that makes compartment **21*a* move forwards one step, i.e., a quarter of a turn of shaft 78 (FIG. 7). By advancing one step compartment 21*a* presents its own opening opposite to the passing opening of compartment 32 and is frontally placed with respect thereto. During the forward movement of cop 20 with compartment 21*a* by one step, cop 20 is withheld from being discharged by lateral protection wall 22 until it becomes positioned with its respective parts above and below the yarn between two forks 56, which are appropriately located on shaft 57. There could be a third fork 56 in a higher position than the others and suitable for positioning the end yarn 40 and, therefore, for making easier the placing thereof in the thread clearer device 45 and in retaining device 34. Meanwhile pincers-type retaining device 34 is opened by the action of the fixed cam 39 on pin 38, which through lever 37 has overcome the resistance of a spring (not shown) and opened jaw 36 (FIG. 3**).

As sliding means 29 and, therefore, compartment 32 continue to move forwards, pin 52 begins to act against cam 62 (FIG. 8) of lever 82, which is thus thrust backwards. This action causes small shaft 57 to carry out an angular turning and to take with it also the forks 56 (see FIG. 4). Forks 56 draw with them cop 20 which was in compartment **21*a* and place it in compartment 32. The lower part of cop 20 always slides on surface 83. Simultaneously the end of the yarn prepares itself to be grasped by pincers-type retaining device 34. As forward movement continues (FIG. 5), retaining device 34 closes because it ceases to feel the action of cam 39 and clamps the end of the yarn. At the same time the end of the yarn moves into open space 46 of detector 43. Having ascertained the presence of the end of the yarn with detector 43, thread-clearer 45 causes shears 44 to act and to cut the end of yarn 40. The upper part of the end of the yarn is sucked away by 27, while the lower part, which is actually shorter than it seems in FIG. 5 where the components are shown spaced out so as to make clearer their position and methods of working, is placed on retaining device 34. Meanwhile, as soon as pin 52 has moved beyond cam 62, forks 56 automatically re-position themselves (see FIG. 5) owing to the action of a spring not shown. After passing beyond cam 62, pin 52 meets detector 61 which emits a signal to actuate the cylinder 75. However, actuation of the cylinder is prevented during emission of the signal from the thread clearer 45** indicating that the end of the yarn has been located.

Thus, if the end of the yarn has been located, no signal reaches cylinder 75 and pin 52 passes along 54. Whenever, however, there is no signal from thread-clearer 45, the signal of detector 61 actuates cylinder 75 and switch 50 is moved thereby and pin 52 must pass along track 84 and as pin 52 moves along track 84, compartment 32 passes above the empty space 53 and cop 20 therein without the end of its yarn 40 found, is discharged.

There has been described a preferred, non-limitative layout of a device in accordance with the present invention, but modifications and variants are possible without departing thereby from the compass of the inventive idea.

Thus, it is possible to modify shapes and dimensional proportions between the various parts; to replace the step-by-step conveyor mentioned with a circular conveyor or with one positioned differently, for example at the head instead of at the side; to arrange that compartments 32 open perpendicularly to sliding means 29 instead of opening like a book; to arrange that shaft 57 should be actuated by a piston through a lever or rack; to arrange a mechanical retaining device instead of retaining device 27; to modify the temporary disposition of some components if the step-by-step conveyor be replaced; to arrange that device 43 for verifying the presence of the end of the yarn and shears 44 should be separated and should not be one unit as they are in electronic thread-clearer 45 as foreseen in the example of the invention; to arrange that switching device 58 should move laterally instead of moving down out of sight and to modify the type and shape of detectors 60 and 61. These variants are marginal and do not impair the essence of the invention, as any technician in this field can see clearly.

What is claimed is:

1. A device for transferring a cop with a yarn end pulled out into a compartment having a longitudinal axis of a movable storage member from a step-by-step conveyor compartment with a longitudinal axis positioned parallel to the longitudinal axis of the movable storage compartment at a point of transfer comprising a fixed means to retain the yarn end on the cop when found, pivotal fork means, which can be positioned at an angle and which transfers cops from the step-by-step conveyor compartment to the compartment of the movable storage member, a pincer means, which can be opened and which retain the end of the yarn when found, integrally fixed to and located on the top of each compartment of the movable storage member, a means for verifying the presence of the end of the yarn positioned above said pincer means, shears positioned with said verifying means for cutting extending yarn between said fixed means and said pincer means, and a control device reactive to said verifying means positioned to discharge a cop having a yarn end which has not been found, said pincer means, verifying means and shears lying within a common plane.

2. The device of claim 1 wherein an entry opening of the means for verifying the presence of the end of the yarn and an entry opening of the shears lie in a common plane passing through said fixed means for retaining the end of the yarn when found and a meeting point of the pincers of the retaining means present in and at the top of the compartments when these latter have been moved laterally by a cam means which pre-arranges the compartments for the introduction of the cop.

3. The device of claim 1 wherein said fork means are positioned laterally and at an angle with respect to the compartments of the step-by-step conveyor and normally cooperate with said compartments of said step-by-step conveyor.

4. The device of claim 3 wherein said fork means are mounted on a shaft and includes means provided for controlling rotation of the shaft in accordance with the position of the compartments of the movable storage member in transferring the cop from the compartment of the step-by-step conveyor to said compartment of the movable storage member.

5. The device of claim 3 wherein fork means are positioned below and above said compartments to engage the cop below and above the wound yarn.

6. The device of claim 3 wherein said fork means are vertically integrally joined to the shaft, and includes below said shaft some means for controlling lateral positioning.

7. The device of claim 6 including a cam means which pre-arrange a compartment of the movable storage member and wherein said means for controlling lateral positioning of the fork means comprise levers, one of which is shaped at its end as a cam and cooperates with said cam means.

8. The device of claim 6 wherein said means for controlling lateral positioning of said fork means comprise a piston which cooperates torsionally with said shaft which supports and guides said fork means.

9. The device of claim 7 including a pin attached to said compartments of said moving storage member sliding in said cam means which pre-arrange a compartment of the movable storage member and which have, in the order of forward movement of said pin which guides the movement of said compartment, a switching means, a first cam section which moves an empty cop compartment out of a line of direction of movement of filled cop compartments of the movable storage point, a second cam section which runs parallel to the direction of movement of said filled cop compartments, a means for switching cops having a yarn end which has not been found, a third cam section for deviating and discharging a cop having a yarn end which has not been found, a fourth cam section for returning a filled cop compartment with found yarn end to the line of direction of movement of filled cop compartments and a fifth cam section for returning an empty cop compartment to the line of direction of movement of filled cop compartments, whereby in said second cam section there are a means for controlling a forward step of the step-by-step conveyor, a means for controlling lateral positioning of said fork means and a means for controlling activation of said means for switching a compartment with a cop having a yarn end which has not been found.

10. The device of claim 9 wherein said means for controlling activation of said means for switching a compartment with a cop of which the end of the yarn has not been found emits a signal to cause said switching means to operate in the absence of a signal from said verifying means caused by the absence of the end of the yarn from said verifying means.

* * * * *